US005181295A

United States Patent [19]

Demuth et al.

[11] Patent Number: 5,181,295

[45] Date of Patent: Jan. 26, 1993

[54] METHOD OF CONTROLLING MACHINES FOR CLEANING OF FIBERS

[75] Inventors: Robert Demuth, Nurensdorf; Jurg Faas, Dinhard, both of Switzerland

[73] Assignee: Maschinenfabrik Rieter AG, Winterthur, Switzerland

[21] Appl. No.: 673,418

[22] Filed: Mar. 22, 1991

[30] Foreign Application Priority Data

Mar. 22, 1990 [CH] Switzerland ..... 957/90

[51] Int. Cl.[5] ..... D01G 9/00

[52] U.S. Cl. ..... 19/65 A; 19/200; 19/80 R; 19/98

[58] Field of Search ..... 19/65 R, 65 A, 200, 19/202, 204, 80 R, 80 A, 98, 145.7

[56] References Cited

U.S. PATENT DOCUMENTS 4,858,277 8/1989 Pinto et al. .

FOREIGN PATENT DOCUMENTS 28291 5/1981 European Pat. Off. ..... 19/98
0331039 9/1989 European Pat. Off. .
399315 11/1990 European Pat. Off. ..... 19/65 X
409772 1/1991 European Pat. Off. ..... 19/200
452676 10/1991 European Pat. Off. ..... 19/200
3906508 9/1989 Fed. Rep. of Germany .
2612206 9/1988 France .
2204152 11/1988 United Kingdom .
2210907 6/1989 United Kingdom .

*Primary Examiner*—Werner H. Schroeder
*Assistant Examiner*—Michael A. Neas
*Attorney, Agent, or Firm*—Sandler, Greenblum & Bernstein

[57] ABSTRACT

Machine setting values containing similar functions are grouped together as a group in a setting value table and as many tables, as present groups, are correlated to machine operating elements. Parameter vectors are obtained from each table, effectuating a predetermined machine setting and the totality of the parameter vectors represent (for instance along a diagram axis) settings for the associated operating element. The group formation of setting values for a fine cleaning machine encompasses, for instance, setting values of the knife or carding element-distance from the beater circle, the point density of the carding element, the clamping distance of the feed trough or funnel from the clothing of the opening roller, and the rotational speed of the opening roller. These setting values are grouped together in a first group and included in a first table for forming parameter vectors for the cleaning intensity. The offset distance between a fiber guide and knife and the length of the separation gap between the knife and fiber guide are grouped together in a second group and included in a second table for the formation of parameter vectors for the quantity of waste. The setting elements of the fine cleaning machine can be linked by these parameter vectors and characteristic numbers of the parameter vectors are correlated to a respective operating element, which operating elements, due to linking of the setting elements by the table-linking, in each setting collectively define a working point of the fine cleaning machine.

15 Claims, 4 Drawing Sheets

| P21 d[mm] | P22 Z[1] | P23 k[1] | P24 n[U/min] |
|---|---|---|---|
| 1mm | 2 | 0,1 | 1'500 |
| ⋮ | ⋮ | ⋮ | ⋮ |
| 2,5mm | 1,5 | 0,25 | 1'000 |
| ⋮ | ⋮ | ⋮ | ⋮ |
| 4mm | 1 | 0,4 | 500 |

l = 10mm + K·St

P31
P32

| s[mm] | l[mm] | PV |
|---|---|---|
| 0 | 15 | 1,0 |
| 1 | 18 | 1,2 |
| 2 | 21 | 1,4 |
| 3 | 24 | 1,6 |
| 4 | 27 | 1,8 |
| 5 | 30 | 2,0 |

| P21 | P22 | P23 | P24 |
|---|---|---|---|
| 1 mm | 2 | 0,1 | 1'500 |
| . . . . | . . . . | . . . . | . . . . |
| 2,5 mm | 1,5 | 0,25 | 1'000 |
| . . . . | . . . . | . . . . | . . . . |
| 4 mm | 1 | 0,4 | 500 |

$l = 10\,mm + K \cdot St$

METHOD OF CONTROLLING MACHINES FOR CLEANING OF FIBERS

BACKGROUND OF THE INVENTION

1. Field of the Invention

The present invention broadly relates to a new and improved method of controlling machines for the cleaning of fibers. In particular, the invention concerns textile technology, and specifically, deals with a method for conjointly controlling adjustment or setting means at one or a number of flock opening- and fiber cleaning machines which are in a predeterminate correlation with respect to one another.

2. Discussion of the Background and Material Information

During cotton cleaning, the flock opening- and fiber cleaning functions are controlled in textile cleaning machines with the aid of variable parameters. As a function of the magnitude of these variable parameters there are set or adjusted appropriate adjustment or setting means or elements during the operation of the machines. This setting or adjustment operation is undertaken as far as possible such that no machine components (the tools or operating implements) need be exchanged. Such adjustments or settings as a function of the parameter values, can be either accomplished manually at adjustment or setting elements especially provided for this purpose, for example, at a scale or graduated disk, while displaying the position of a value or values correlated to the setting, or else can be accomplished automatically and under remote-control by appropriately designed operating means and sensing means.

In the case of the so-called Unifloc method of the assignee of this invention, which is a method for opening cotton bales and for opening the pressed bales so as to form cotton flocks, the parameters for the bale hardness are constituted, for instance, by the bale penetration depth of the opening or extraction roller for each throughpass thereof, the protrusion of the individual toothed disks of the opening roller beyond the associated grate structure, the rotational speed of the opening roller, and in the case of bale opening equipment operating with two bale opening rollers the penetration depth of the individual opening rollers. All of these factors thus constitute "adjustment" or "setting" parameters, for the realization of which it is incumbent to adjust or appropriately set one or a number of these mechanical expedients or means.

In a coarse cleaning machine, in which, as the term itself connotes, coarse contaminants or impurities are removed and flocks are already partially opened, relevant parameters are constituted by, for instance, the spacing of the individual grate rods from the imaginary outermost circumferential surface of the beater bolts at the cleaning roller, the angular setting of the individual grate rods and the spacing to the aforementioned circumferential surface of the beater bolts and the angular mutual position of the grate rods with respect to one another, the rotational speed of the cleaning roller, and the suction intensity of the air quantity suctionally removed through the sheet metal sieve or screen plate.

Relevant parameters of a fine cleaning machine, where there occurs intensive opening of the flocks, are constituted by, for example, the distance between the nip or clamping point and the takeover point at the feed roll or roller, the spacing of the knife edge from the beater circle, the displacement or offset of the sheet metal fiber guide to the knife as well as the rotational speed of the opening roll and, possibly, also the point density to the extent these points can be adjustably altered (and not merely by exchange thereof).

Finally, the carding machine or card is also present in this processing line. Such carding machine has a multiplicity of parameters for combing out short fibers and for placing the cleaned fibers in parallelism, such as, for instance, the clamping distance between the feed plate or trough for the fiber infeed and the clothing of the licker-in roll, the rotational speeds of the licker-in roll and the carding cylinder, the settings of the flat arrangement, carding elements, separating knife and so forth, which likewise can possess a pronounced dependency upon one another.

All of these adjustment or setting parameters, in other words, each individual one, have boundary values between which they can be altered by adjustment of the relevant operating element. They constitute the mechanical boundary or limiting conditions of the machine. Furthermore, these parameters are interdependent, and thus, dependent upon one another. In other words, alteration of one of these parameters affects, on the one hand, the total effect and, on the other hand, the partial effect of the other parameters. It is known that a system containing such type of interdependent, linked partial influencing factors, is difficult to control.

If there is further considered the fact that, depending upon the prevailing fiber arrangement, that is, depending upon the blend of the fiber origin, namely, fiber length, thickness, color, elongation of the individual fibers according to fiber origin, as well as dependent upon the nature and degree of contamination, the alterations of the parameters produces a different technological result.

SUMMARY OF THE INVENTION

Therefore, it is a primary object of the present invention to provide a simplified adjustment or setting possibility at the control for a machine or at the control for a number of machines or at an installation, which is capable of being adjusted manually as well as automatically, and the adjustment or setting operations are accomplished as if the parameters were individually adjusted.

Now in order to implement this object and still further objects of the present invention, which will become more readily apparent as the description proceeds, the method of the present development for the control of a machine or machine groups for cleaning of fibers, is manifested, among other things, by the features that there are allocated machine setting values of the machine or machine group into a first machine operating function representative of the intensity of cleaning of the fibers and a second machine operating function representative of the quantity of fiber waste, these machine setting values being representative of predetermined variations of setting possibilities of setting elements of the machine or machine group. There is formed a parameter field representing a region of useful fiber treatment results derived from a respective table whose contents have been empirically determined for the intensity of cleaning of the fibers and for the quantity of fiber waste, respectively. The parameter field establishes an applicable useful range of the setting possibilities of the setting elements of the machine or the machine group with regard to the intensity of cleaning of the fibers and the quantity of fiber waste, and there is selected a working point within the parameter field, upon operation of the machine or the machine group, to derive control signals for setting of the setting elements with regard to the intensity of cleaning of the fibers and the quantity of the fiber waste.

A further aspect of the invention contemplates employing the derived control signals for displaying settings of the setting elements. Moreover, the control signals are capable of being employed in a control system for perfecting setting of the setting elements.

According to further features of the present invention there are derived machine setting values of the first machine operating function from setting elements of a fine cleaning machine which are effective upon the fibers in respect of the cleaning intensity of the fibers. There are grouped together into one of the respective tables the derived machine setting values of the first machine operating function representative of the intensity of cleaning of the fibers. There are also derived machine setting values of the second machine operating function from setting elements of a fine cleaning machine which are effective upon the fibers in respect of the quantity of waste of the fibers, and there are grouped together into a remaining one of the respective tables the derived machine setting values of the second machine operating function representative of the quantity of waste of the fibers.

By the same token there can be derived machine setting values of the first machine operating function from setting elements of a coarse cleaning machine which are effective upon the fibers in respect of the cleaning intensity of the fibers, and there are grouped together into one of the respective tables the derived machine setting values of the first machine operating function representative of the intensity of cleaning of the fibers. Moreover, it is possible to derive machine setting values of the second machine operating function from setting elements of a coarse cleaning machine which are effective upon the fibers in respect of the quantity of waste of the fibers, and there are grouped together into one of the respective tables the derived machine setting values of the second machine operating function representative of the quantity of waste of the fibers.

As far as further attributes of the invention are concerned, it is contemplated to derive machine setting values of the first machine operating function from setting elements which are effective upon the fibers in respect of the cleaning intensity of the fibers and there are grouped together into one of the respective tables the derived machine setting values of the first machine operating function representative of the intensity of cleaning of the fibers. There are also derived machine setting values of the second machine operating function from setting elements which are effective upon the fibers in respect of the quantity of waste of the fibers and there are grouped together into a further one of the respective tables the derived machine setting values of the second machine operating function representative of the quantity of waste of the fibers. Additionally, there are derived still further machine setting values of a still further machine operating function from setting elements which are effective upon the fibers in respect of carding of the fibers and, here also, there are grouped together into a still further table the derived still further machine setting values of the still further machine operating function which are effective upon the fibers in respect of carding of the fibers.

Still further, there can be derived machine setting values in respect of bale hardness from setting elements of a bale opening machine which are effective upon the fibers in a bale and there are grouped together into a further table the derived machine setting values in respect of bale hardness.

It is contemplated that the grouping together into the one respective table of the setting values of the setting elements of the fine cleaning machine entails grouping together into a first group setting values of selectively at least any of the distance of a knife from a beater circle, the distance of a carding element from the beater circle, a predetermined point density of the carding element, a clamping distance of a feed trough with respect to clothing of an opening roller, and the rotational speed of the opening roll, further that, the grouping together into the remaining one of the respective tables of the derived machine setting values of the second machine operating function representative of the quantity of waste of the fibers entails grouping together into a second group an offset distance between a fiber guide and the knife and the length of a separation gap between the knife and the fiber guide.

The machine setting values can be displayed as readable values and there are performed manual total settings of the machine or machine group with the aid of the displayed machine setting values.

Furthermore, the machine setting values can be represented as reference values for sensing means and operating means, in order to be able to carry out computer-controlled total settings of the machine or machine group.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the fiber cleaning or processing equipment and related structure has been depicted therein, in order to simplify the illustration, as needed for those skilled in the art to readily understand the underlying principles and concepts of the present invention.

It is here first of all mentioned that, as a starting point, the multiplicity of parameters, considered in groups, could possess similarities in their effect and that this type of "allied relationship" can be exploited to order the parameters in accordance with common criteria, to group them together, and to incorporate them in the control method or process. In the description to follow there will be given an example of two such group parameters which are superordinate or primary parameters, namely, the group parameter "cleaning intensity" and the group parameter "quantity of waste", sometimes referred to briefly herein as simply "waste". The grouping together of bale opening parameters, flock opening parameters, cleaning parameters and so forth into group parameters will be explained hereinafter based upon the following example and following criteria:

In the case of a fine cleaning machine, there are settings or adjustments which can be accomplished at the machine elements which primarily influence the intensity of the cleaning of the fibers, in other words, also influence the mechanical loading of the fibers. For instance, such is the spacing or distance P4, shown in FIG. 6, that is, the distance between the clamping line or nip at the fiber feed trough or plate and the takeover line or location of the clothing of the opening roll or roller, this distance or spacing P4 being set or adjusted as a function of the fiber origin. A further such setting is the distance d shown in FIG. 5, designated by P7 in FIG. 6, between the separating means (knife) and the beater circle of the clothing of the opening roll or roller. Still a further such setting is the point density z of the carding element as well as also the rotational speed n of the opening roll (see FIG. 5). This means cleaning the fibers while loading the same so that there is achieved as little loss in fibers as possible.

Now if these individual functions are grouped together into a group, then there results a magnitude which can be converted into an adjustment or setting number or value and which is representative of the intensity of the cleaning operation.

Figure 5:
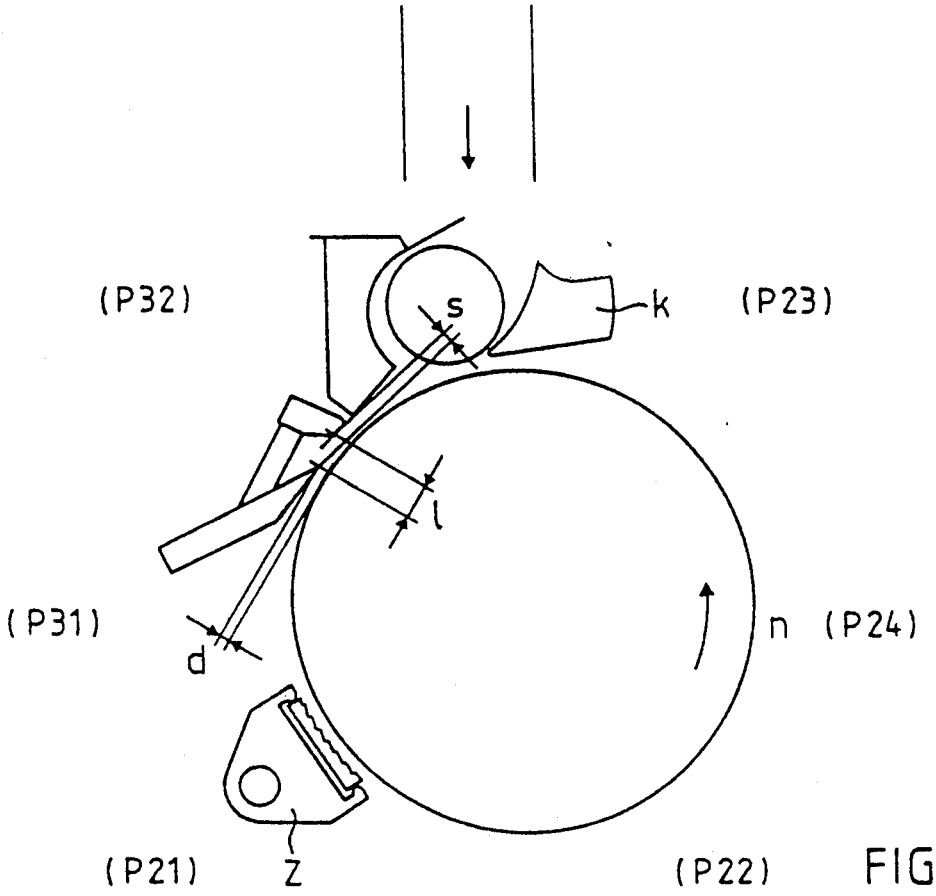
FIG. 5 schematically illustrates the characteristic values at a fine cleaning machine.

In a fine cleaning machine, there are, however, also settings which can be made at machine elements which predominantly affect the removal of the contaminants and only to a slight degree the mechanical loading of the fibers. As shown in FIG. 5, these settings are, for instance, the displacement distance or offset s between the metal fiber guide and the knife of the separation stage at the opening roll, by means of which there is adjusted or set the depth of the separation. A further setting is the length l of the separation gap between the knife and the metal fiber guide of the separation stage at the opening roll. However, the suction prevailing at the outlet of the opening roll also influences the quantity of waste. This means, cleaning of the fibers in a protective fashion but with loss of fibers.

If these individual functions are grouped together into a group, then there results a further magnitude which can be represented as a number, representative of the interval at which there is undertaken fiber cleaning.

Therefore these two groups of parameters differ by the following characteristics: The one group of parameters predominantly influences the mechanical loading of the fibers, which is proportional to the cleaning intensity. The more intensively the fibers are cleaned the more fiber damage arises. Therefore, a choice is possible between fiber load and degree of cleaning. The other group of parameters predominantly influences the quantity of waste of the fiber material, which is proportional to fiber loss, even if later on in another cleaning operation there should occur a recuperation. Therefore, there prevails a compromise between degree of cleaning with fiber loss and degree of cleaning with fiber loading.

Prior to the start of the cleaning process, the operator can select obtaining the desired degree of cleaning with more fiber loss or with more mechanical damage, and during the cleaning process, depending upon the result, at any time can initiate a change at only two operating elements which control the entire operating means and sensing means. According to a further expansion of the teachings of the invention, both of these operating elements also can be activated by means of a computer control, and the computer also selects the "tables" from a library, gets these tables and sets the operating elements. As already stated, it is thus possible to control in a very simple manner, by means of such a pre-linking, exceedingly complex interrelated machine functions.

As a general rule, it is easy to reach a decision between two distinct parameters which are well known to the machine operator. In any case, this is certainly a simpler task for the operator of the machine or installation than if he or she had to realize such decision by taking into account the large number of possible machine adjustments or settings. However, if the machine operator is afforded the possibility of predominantly selecting a fiber-protective setting with a great deal of fiber waste or predominantly selecting a setting working with a great deal of loading of the fibers, or a hybrid of these two possibilities, and if the selection can be made by the machine operator at two indicators or setting elements (fiber loading and quantity of fiber waste), then, as a general rule, it will be possible for the machine operator to achieve in a simple manner a very efficient operation of the machine. As a result, there are also beneficially incipiently eliminated an entire number of possible error sources and there are at least partially minimized disturbances or distractions, such as telephone calls to the machine operator during the time of performance of the machine setting work.

Viewed quite generally, to a considerable degree of abstraction, the adjustable functions at a machine or a linked group of machines, can be manipulated in a superordinate or primary fashion, as follows: Groups of adjustment or setting means are grouped together according to a "commonly operating" function. The setting magnitudes of these adjustment or setting means are incorporated as parameters into a look-up table, for instance, into the columns of the table. Vectors are formed from the lines of the table (or columns), which receive characteristic numbers or coefficients. As a result, there are obtained a series of characteristic numbers or coefficients which are ordered in dependence upon the effectiveness of the common function. These tables, together with their sets of vectors, can be linked together, in dependence upon their relevant function, into a superordinate or primary function. A function formed from two tables defines a two dimensional parameter field or zone, and when employing three tables there is defined a three dimensional field or zone.

Figures 1, 2, 3:
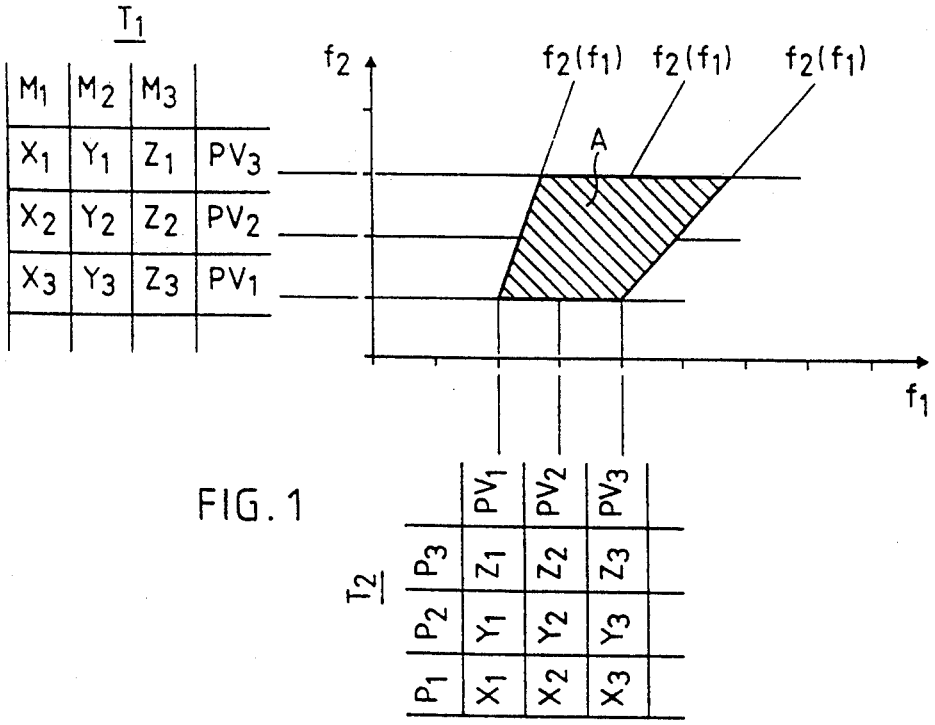
FIG. 1 depicts in an abstract representation of the principles of the inventive method.
FIG. 2 illustrates in a table the manner in which individual parameters can be grouped together in order to be further employed as a group parameter.
FIG. 3 shows in a different table the manner in which further parameters can be grouped together in order to be further employed as a group parameter.

The values in the table are experimentally determined. These determined values are characteristic for a machine or for an interlinked machine group. FIG. 1 depicts an abstracted representation of two tables $T_1$ and $T_2$ which represent two parameter groups, namely the parameter group $M_1$, $M_2$ and $M_3$ containing the one characteristic and the parameter group $P_1$, $P_2$ and $P_3$ containing the other characteristic. The parameters are arranged in the table columns. The table lines, each with the value X of all parameters participating in the table, form the parameter vectors. These parameter vectors are portrayed in an ordered fashion along a respective axis $f_1$ and $f_2$ of a diagram or graph in the sequence of their appearance in the table. Since of concern is a linked system, meaning a machine or a machine group, these axes $f_1$ and $f_2$ can be considered as variables or better still as functions, which are functionally interdependent. In the diagram or graph of FIG. 1 this has been symbolically illustrated by a parameter family $f_2(f_1)$. The intersection points of the parameter vectors of both axes form a matrix of the working or operating points of the machine or machine group and thus define a parameter field or working or operating point field within which there can be selected every random position with the aid of an adjustment or setting of $f_1$ and $f_2$. This is possible through the adjustment of only two magnitudes, namely the vector parameters PV of the one and the other group or tables. Outside of the predetermined working or operating point field or zone, it is not possible to set any other working or operating points, and the depicted working point field encompasses all useful or possible settings in conjunction with the employed tables.

It should be apparent that by means of these tables the machine is adjusted or set in a rather complicated manner in order to perform its momentary task. Conversion of machine operation for performing a different task or object is accomplished by exchanging the tables. As a result, the machine or machine group can be optimumly operated with less control expenditure, for instance, for a machine operator operating the machine or machine group. Moreover, hidden faulty settings, as, for instance, "a setting in the impact position", as such can easily and frequently arise, as a rule, in more complex systems and can go unnoticed, are completely precluded in this manner.

This grouping of parameters, that is, the determination of the values X, are resolved one time, for instance, at the start of an operating task of the machine or machine group, by performing a series of trials at the machine or a particular type of machine or machine group. A one time determination is made of the results of the different parameters, in other words, there is determined a single time the setting magnitudes at the machine. There then can be derived therefrom a cleaning program, by means of which there can be primarily selected the brightness of the waste composition (the greater the brightness the greater the proportion of good fibers in the waste) and the cleaning intensity (the greater the cleaning intensity the greater the possibility of fiber damage). Such an example has been depicted in the tables of FIGS. 2 and 3. Such constitutes a proposal for collecting the group parameters and finally for the formation of a two dimensional characteristic field, which encloses or encompasses the settable operating conditions, and it is unimportant whether the machine setting is performed manually or automatically by operating means and sensing means.

An Example for a Fine Cleaning Machine

As far as the setting or adjustment magnitudes are concerned for the fiber cleaning intensity and the quantity of waste, there are known as empirical values the tendency of the changes in the fiber waste quantity and its composition as well as a coarse relative change factor of the fiber waste quantity. However, such provides no information concerning the absolute removed fiber quantity (such can vary by a factor of up to 40 and more) and also no information regarding the change factor of the composition (which is markedly dependent upon the fiber material) and the absolute composition of the fiber waste quantity.

The criteria for the formation of a first group of setting parameters is the cleaning intensity (see the table of FIG. 2). In this first group there are grouped together all of the setting operations at a machine which influence the intensity of fiber cleaning. The table depicts four columns containing four different parameters P21, P22, P23 and P24, namely: the distance d to the beater circle amounting from 1 mm. to 4 mm. (P21); the relative point density z of 2 to 1 (P22); a factor K in conjunction with the clamping or nip distance $l=10$ mm.+K.St, wherein St constitutes the classified staple length, and the factor K varies from 0.1 to 0.4 (P23); and finally, the rotational speed n of 1500 rpm to 500 rpm (P24) of the opening roll or roller-- in the drawings, the term U/min equally signifies revolutions per minute. At the top of the column there appear the values of greater intensity, and toward the bottom of the table the intensity values diminish.

The respective lines of all four columns form a common cleaning number or factor. All ten lines form a value series between 0 and 1. These values constitute allocations and only represent a line with four parameter values, like a vector (it would be possible to also label the values 0; 0.1; ..0.5 ..1.0, as line numbers or vector numbers). If there is used the expression "intensity vector", then the intensity vector 1.0 would exhibit the largest cleaning intensity and pre-suppose the machine settings: $d=1$ mm.; $z=2$; $l=0.1$ mm. and $n=1500$ rpm. In the table 2 there have only been given both of the boundary values and a mean value in order to avoid over-cluttering of the table with numerical values.

Waste (quantity of fiber waste) constitutes the criteria for forming a second group of setting or adjustment parameters (see the table of FIG. 3). In this second group, there are grouped together all of the setting operations at a machine which are decisive for waste. The table portrays two columns with the boundary values of two different parameters P31 and P32: displacement s (mm.) of the metal fiber guide with respect to the knife amounting from 0 to 5 (P31); length l (mm.) of the separation gap between the metal fiber guide and the knife amounting from 15 to 30 (P32). The line correlations of 1 to 6 correspond to waste vectors PV having two parameter values. They can be termed waste vectors, and the waste vector of the line correlation 6 constitutes the largest waste vector and the waste vector of the line correlation 1 constitutes the smallest waste vector. Thus, the waste vector PV of the value 2 would be representative of a machine setting or adjustment for a displacement $s=5$ mm. and a length $l=30$ mm.

Both of the group parameters then form a respective group of setting or adjustment parameters (setting operation) through which there can be influenced the fiber cleaning intensity and the quantity of waste. Each group possesses a set of setting or adjustment vectors which are determined by a series of experiments. The random correlation of two setting vectors from a respective group produces a working or operating point within the entire cleaning program, which can be adjusted by means of only two setting or adjustment devices.

Figure 4:
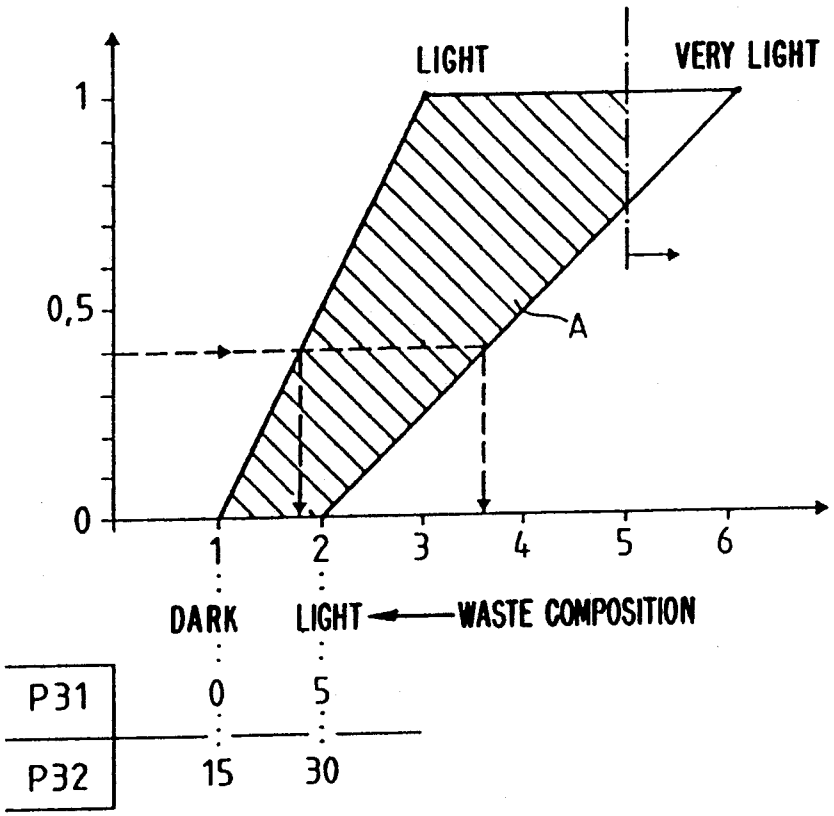
FIG. 4 illustrates the manner in which such group parameters which, in turn, are grouped together, define a characteristic field or zone in which there are confined the mechanical, and thus, also the functional boundary conditions.

Such a "cleaning program" has been illustrated in the diagram of FIG. 4. This diagram can be produced either for a machine or a machine group or for an entire installation, and with increasing linking of the individual types of machines the complexity does not increase linearly. In the embodiment under discussion of a fine cleaning machine, there have been shown in FIG. 5 the indicators or setting elements which are grouped together into two groups and mutually linked. The depicted diagram is defined by two group parameters, namely, the group embodying the cleaning-intensive setting magnitudes or values P21, P22, P23 and P24 and the group embodying the waste-intensive setting magnitudes or values P31 and P32, which magnitudes or values can be divided into vectors of different effective intensities. The intersection points represent working or operating points and the shaded surface describes a field or zone containing all possible working or operating points which can be set at the machine. Working points located externally of the field are not attainable, since there is present at least one setting limitation at the machine and this value simply can not be set at the machine.

It will be recognized that when setting waste with which there are correlated the setting value s=0 mm. for the displacement or shift of the metal fiber guide and the knife and the setting value l=15 mm. for the length of the separation gap between the metal fiber guide and the knife, corresponding to a parameter vector PV of 1 (see FIG. 3), with increasing cleaning intensity the waste becomes brighter. In the case of setting values of s=5 mm. and l=30 mm., corresponding to a parameter vector 2, this is even more pronounced. In other words, the waste also is a function of the cleaning intensity. Assuming that the setting boundaries of the waste-effective setting magnitudes amount to minimum 1 and maximum 2, then for cleaning intensities between 0 and 1 there results a working or operating range which can be used by virtue of performing settings or adjustments at only two indicators or setting elements. A possible limiting of the working or parameter field in order to preclude possible disturbances at the machine, has been shown at the upper right-hand portion of the working field. Here, there is introduced an additional limit, which is not a setting boundary, to preclude clogging of the waste removal path with too large a quantity of waste. Furthermore, there is shown that with the selection of the cleaning intensity equal to 0.4, the waste can vary between 1.8 and 3.6. The waste setting of 1.3 with a cleaning intensity of 0.4 would produce a waste of approximately 2.4.

These numerical values are relative values which can be used to determine the absolute quantity of waste insofar as there are known additional influencing magnitudes, such as production, contaminant content, type of contaminants and so forth. These are influencing magnitudes which are given by the fiber origin and the nature of fiber processing and can be experimentally or empirically derived. As soon as they are once known, then there can be reproducibly set the fiber waste quantity within certain limits in relation to the fiber cleaning intensity. The boundary lines of the shaded diagram can be considered as the extreme positions of the adjustable or setting elements, that is, as the setting range of such adjustable elements. Moreover, the intermediately situated region can be considered as possible intermediate settings for the adjustable elements. Hence, there can be set by means of two indicators or adjustment elements the production result.

Since the elements which have been set as a consequence of a pre-selection deliver different technological results when working with different fiber origin blends, depending upon the fiber origin blend it is necessary to select a different cleaning program, that is to say, different vector element values. These are likewise determined by conducting a series of tests or experiments, in other words, empirically, and the results can be deposited in the form of look-up tables, like those shown in FIGS. 2 and 3, in a "library" from which they can be retrieved when needed, in order to have available a specific cleaning field, as the same has been depicted in FIG. 4.

The procedures for the selection and for the use of such a cleaning program, in other words, the operation of the machines or installation, could be accomplished, for instance, as follows. The operator of the machine or installation selects the table in accordance with the previously determined mean value of the classified staple, for instance, cotton staple of ⅞ inch to 1.5 inches in 1/16 inch steps, corresponding to a fiber length of 22 mm. to 38 mm. From this, there is determined the clamping distance or nip. As a function of the degree of contamination of the cotton to be cleaned, there is then selected a degree of the cleaning intensity within the shaded cleaning program or parameter field which is considered to be proper for the fibers which are to be cleaned (mechanical loading of the fibers). Then there is selected the relative value or number for the waste, that is, the machine operator or user determines the acceptable degree of loss of good fibers. With the aid of the interlinked tables there is set a working or operating point within the shaded surface and which fulfills these prerequisites. After evaluating the cleaned cotton there can be still undertaken a correction in both dimensions of the parameter, that is to say, in the two dimensional direction, in other words, within the effective region of the setting field or zone. It will be understood that this working point produces at the corresponding machine or at different machines of an installation or machine group, the requisite predetermined settings of the previously discussed cleaning elements in accordance with the cleaning program. Thus, as a result of these settings or adjustments and the set rotational speeds, there is produced a desirable result at the processed cotton which can be readily later judged or evaluated by the machine operator or user. This product evaluation could be performed by a computer with the aid of a sensor arrangement and regulation device, but such is here not provided on-line in the embodiment under consideration, so that the operator, in the absence of satisfactory cleaning of the fibers must select a new starting or operating point within the characteristic field.

Figure 6:
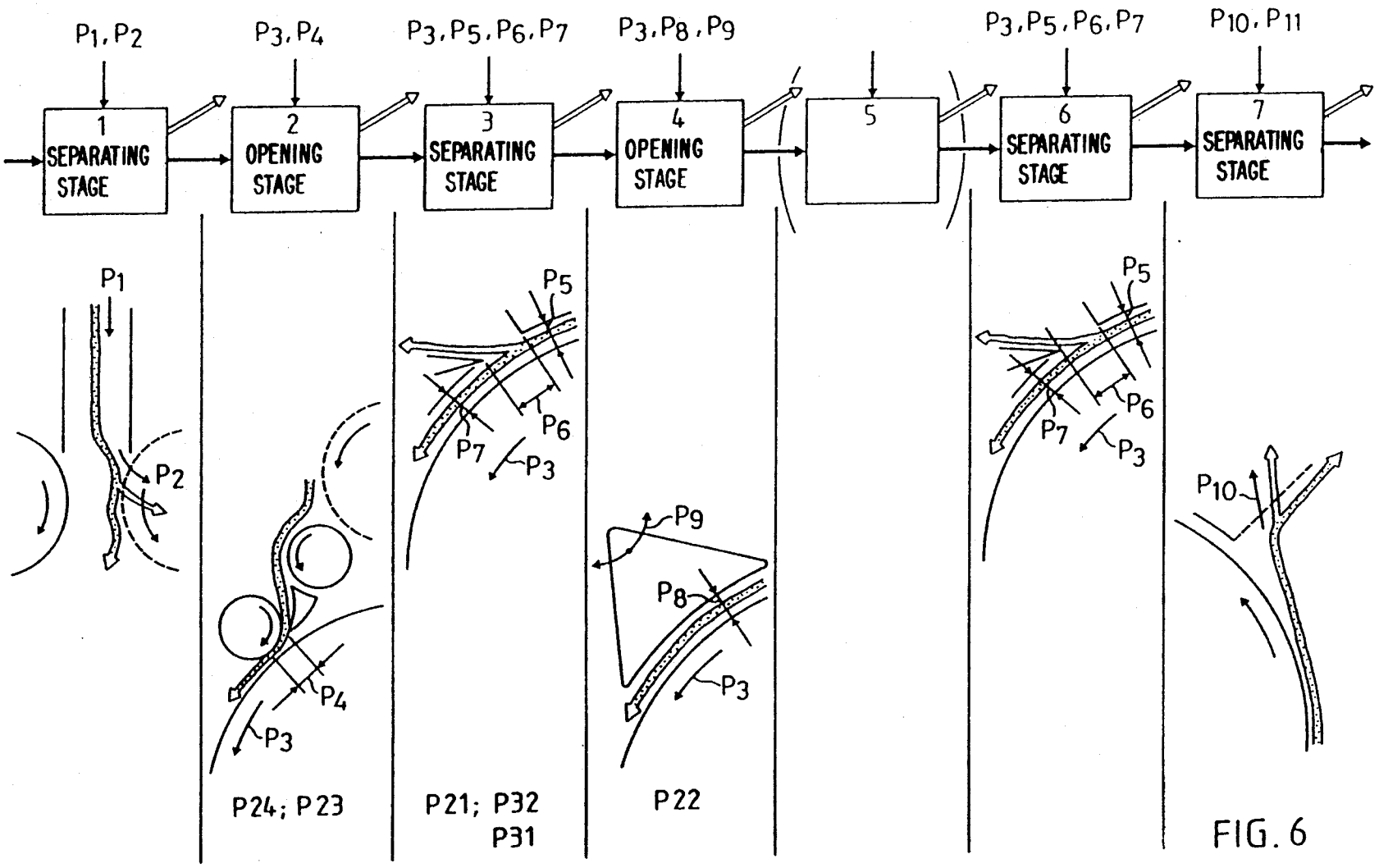
FIG. 6 illustrates the individual functions or operations to which the fibers are exposed when being processed in a fine cleaning machine.

FIGS. 5 and 6 depict the adjustable or settable individual functions at a fine cleaning machine. There has been schematically illustrated an opening roll or roller having a number of peripherally arranged cleaning elements, which in a time sequence can be construed as cleaning stages. FIG. 6 depicts such, once again, in a linear or flow chart representation. Each individual one of the parameters P1 to P11 is associated with an adjustable or settable machine element effective within the cleaning stage (see also, the commonly assigned, U.S. application Ser. No. 07/585,985, filed Sep. 21, 1990, and entitled "Method and Apparatus for the Fine Cleaning of Textile Fibers", to which reference may be readily had and the disclosure of which is incorporated herein in its entirety by reference). At each cleaning stage there appears a thick non-colored arrow representing waste and a thick black colored arrow representing the material throughput. The parameters which act "intensively" upon the fibers are present, for instance, in the stages 2, 3, 4 and 6, and the "intensively" effective parameters as concerns the waste are present, for instance, in the stages 3 and 7. It will be recognized that in one and the same cleaning stage there can be present both types of parameters and that what is decisive is to group together the settings or adjustments of the same desired type of function and not the cleaning stages.

An Example for A Coarse Cleaning Machine

Figure 7:
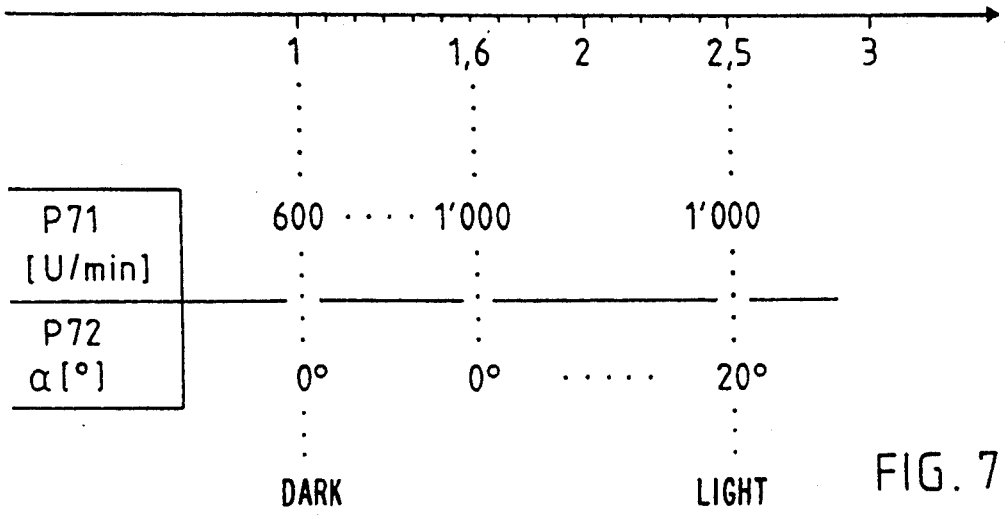
FIG. 7 is a diagram in which there are grouped together the group parameters for a coarse cleaning machine.

FIG. 7 illustrates a cleaning program at a coarse cleaning machine. This type of cleaning machine operates, as concerns cleaning intensity, in contrast to a fine cleaning machine, relatively protectively upon the fibers throughout its entire setting or adjustment range, but nonetheless with a certain intensity, so that also here there is applicable a two dimensional parameter field for the coarse cleaning machine.

Pursuant to the disclosed method, the setting parameters are grouped together into two groups and illustrated as tables. The group relevant to the cleaning intensity encompasses a parameter P71, namely the cylinder or drum rotational speed of 600 rpm to 1000 rpm. The group pertinent to waste quantity also encompasses a parameter P72, namely the grate rod angle $\alpha°$ of 0° to 20°. The lines of the one table form the associated parameter vectors PV, for instance, rpm=600, the other table $\alpha=20°$. Now if, however, there is relinquished the function of the cleaning intensity of a coarse cleaning machine in relation to a fine cleaning machine, then, there is valid a one dimensional parameter with only one table in which the parameter values extend between, for instance, $\alpha=0°$, rpm=600 . . . $\alpha=20°$, rpm=1000. They are listed at a diagram containing an axis representative of "relative number". Since in the last-mentioned situation there does not come into play any second table, the parameter characteristic field is one dimensional and there is required only one operating element for setting the diverse machine elements, of which here two have been indicated in the table.

There is further considered the possibility of using boundary values: with $\alpha=0°$ and with the rotational speed from 600 rpm to 1000 rpm there is produced a relative waste between 1 to 1.6 and with an rpm=1000 with $\alpha=0°$ to $\alpha=20°$ there is produced a relative waste of 1.6 to 2.5. It will be evident from these particular examples that the table-linking affords pronounced simplification of complicated setting operations. Also a linking with three functional-types can still be controlled, if one of the three is conceived such that it only requires a selection and not a setting. An example of such would be a table which lists fiber origins. This three dimensional parameter characteristic field or zone (fiber origin, intensity and waste) is correlated to one fiber origin and both of the other parameters, defining a two dimensional field containing the working or operating points, are set by means of a respective operating element. However, a change-over to a different fiber origin could be rapidly and reliably undertaken and the relevant tables for the other two operating elements or indicators are correspondingly correlated.

This example demonstrates that the method for the formation and utilization of group parameters also can be consistently used in simpler systems. This is not unimportant for the reason that in composites of machine groups (and no longer simply individual machines) there can be also incorporated simpler type machines, namely, machines with lesser or no parameter linking, and importantly, above all without difficulty into the superordinate or primary system.

The example of a coarse cleaning machine demonstrates that criteria, such as how a machine functions in relation to another machine, can be taken into account, and the building or formation of the table and the separation of parameter vectors PV are also valid for a single parameter, and thus, each machine can be incorporated into the concept. The regulation of entire installations is accomplished through optimization by means of a superordinate computer program from which then no part of the installation need be accorded any special treatment.

An Example for a Bale Opener

With this example there is intended to be briefly considered a machine possessing a one dimensional parameter field, the group parameter of which is "bale hardness". Although the bale opener is considered to be part of the cleaning room, it really is not a cleaning machine, but an opening machine which opens the bales.

During the process of opening the bales and for extracting flocks from the compressed cotton, the following parameters prevail for the bale hardness:

(a) penetration depth of the opening or extraction roller per throughpass;

(b) the projection of the individual toothed discs of the opening or extraction roller beyond the associated grate structure; and (c) the rotational speed, and in the case of bale openers working with two opening or extraction rollers, the penetration depth a1 and a2 of the individual opening rollers.

All of these parameters are "setting" or "adjustment" values or magnitudes, for the realization of which one or a number of these mechanical means or expedients must be adjusted or set. The table with the parameters a1, a2, b and c gives the related parameter vectors PV which are plotted along the bale hardness axis, as the same has been already illustrated in FIG. 7. This is then a one dimensional parameter field.

An Example for a Card

The card or carding machine (not shown) can be represented with the aid of a three dimensional parameter field, that is, with the same table technique as for the above-discussed machines (also valid for machine groups), in a "space" or "region" having working or operating points, in which the cleaning intensity, the relative waste quantity and the carding intensity each represent a property group having the associated parameter vectors.

In so doing, the cleaning intensity, is given, for instance, by a clamping or nip distance analogous to the clamping or nip distance which has been designated by P4 in FIG. 6 and/or the rotational speed of the licker-in roll, whereas the waste quantity is given, for instance, by the position of the cleaning knife or blade applied at the licker-in roll, and the carding intensity is given, for instance, by the spacing between the carding elements and the carding cylinder clothing as well as, to the extent alterably present, by the change in the tooth density of the carding elements. These setting or adjustment possibilities in the three groups are only to be considered as examples; naturally there could be grouped together considerably more of them. In this manner, for instance, the nep level can be fixedly determined and then, analogous to the manner of proceeding with a two dimensional parameter field, there is selected the cleaning intensity or the waste. Notwithstanding the possible multiplicity of the setting magnitudes, such settings or adjustments are simple and clear. Also, in this case a complex method or process operation can be rendered optimumly executable with simple means.

In conclusion, there will be summarized an overview regarding the possible parameter fields in the area of cotton cleaning:

One Dimensional: Bale opening with the group parameter, bale hardness. Coarse cleaning with the group parameter, waste quantity (provided that the cleaning intensity does not play any role).

Two Dimensional: Coarse cleaning with the group parameters, cleaning intensity and waste quantity (provided that the cleaning intensity does not play any role). Fine cleaning with the group parameters, cleaning intensity and waste quantity.

Three Dimensional: Carding with the group parameters, cleaning intensity, relative waste quantity and carding intensity (nep level).

Consequently, the manufacturing process up to the production of the card sliver, can be reduced to "tables", and from tables there can be derived further tables with parameter vectors, for example, a grouped together optimized fiber cleaning intensity and quantity of waste for the entire installation apart from tables for bale hardness and nep level. This method is exceptionally suitable for computer-controlled operation with a table library (the indicators are automatically set). However, it is also suitable for manual operation (the indicators are set at the operating elements), something which would not otherwise be possible in a non-tablized form. Under the expression "tablized form" it should be understood that such connotes a setting or adjustment of the machines or installations on the basis of parameter vectors derived from tables.

While there are shown and described present preferred embodiments of the invention, it is distinctly to be understood the invention is not limited thereto, but may be otherwise variously embodied and practiced within the scope of the following claims.

What is claimed is:

1. In a fiber cleaning method comprising the steps of:

allocating machine setting values of a machine or machine group of different machines for cleaning fibers, into a first machine operating function representative of the intensity of cleaning of the fibers and a second machine operating function representative of the quantity of fiber waste;

said machine setting values being representative of predetermined variations of setting possibilities of setting elements of the machine or machine group;

forming a parameter field representing a region of useful fiber treatment results derived from a respective table whose contents have been empirically determined for the intensity of cleaning of the fibers and for the quantity of fiber waste, respectively, said parameter field establishing an applicable useful range of the setting possibilities of the setting elements of the machine or the machine group with regard to the intensity of cleaning of the fibers and the quantity of fiber waste;

selecting a working point within the parameter field, upon operation of the machine or the machine group, to derive control signals for setting of the setting elements with regard to the intensity of cleaning of the fibers and the quantity of the fiber waste;

employing the derived control signals for setting the setting elements with regard to the intensity of cleaning of the fibers and the quantity of the fiber waste; and operating the machine or the machine group with such setting of the setting elements, in order to control the machine or the machine group of different machines for cleaning of the fibers.

2. The method as defined in claim 1, further including the steps of:

employing the derived control signals for displaying settings of the setting elements.

3. The method as defined in claim 1, wherein:

the control signals are capable of being employed in a control system for perfecting setting of the setting elements.

4. The method as defined in claim 2, further including the steps of:

employing the derived control signals for displaying settings of the setting elements; and wherein the control signals are capable of being employed in a control system for perfecting setting of the setting elements.

5. The method as defined in claim 1, further including the steps of:

deriving machine setting values of the first machine operating function from setting elements of a fine cleaning machine which are effective upon the fibers in respect of the cleaning intensity of the fibers;

grouping together into one of the respective tables said derived machine setting values of the first machine operating function representative of the intensity of cleaning of the fibers;

deriving machine setting values of the second machine operating function from setting elements of a fine cleaning machine which are effective upon the fibers in respect of the quantity of waste of the fibers; and grouping together into a remaining one of the respective tables said derived machine setting values of the second machine operating function representative of the quantity of waste of the fibers.

6. The method as defined in claim 1, further including the steps of:

deriving machine setting values of the first machine operating function from setting elements of a coarse cleaning machine which are effective upon the fibers in respect of the cleaning intensity of the fibers; and grouping together into one of the respective tables said derived machine setting values of the first machine operating function representative of the intensity of cleaning of the fibers.

7. The method as defined in claim 1, further including the steps of:

deriving machine setting values of the second machine operating function from setting elements of a coarse cleaning machine which are effective upon the fibers in respect of the quantity of waste of the fibers; and grouping together into one of the respective tables said derived machine setting values of the second machine operating function representative of the quantity of waste of the fibers.

8. The method as defined in claim 1, further including the steps of:

deriving machine setting values of the first machine operating function from setting elements of a coarse cleaning machine which are effective upon the fibers in respect of the cleaning intensity of the fibers;

grouping together into one of the respective tables said derived machine setting values of the first machine operating function representative of the intensity of cleaning of the fibers;

deriving machine setting values of the second machine operating function from setting elements of a coarse cleaning machine which are effective upon the fibers in respect of the quantity of waste of the fibers; and grouping together into a remaining one of the respective tables said derived machine setting values of the second machine operating function representative of the quantity of waste of the fibers.

9. The method as defined in claim 1, further including the steps of:

deriving machine setting values of the first machine operating function from setting elements which are effective upon the fibers in respect of the cleaning intensity of the fibers;

grouping together into one of the respective tables said derived machine setting values of the first machine operating function representative of the intensity of cleaning of the fibers;

deriving machine setting values of the second machine operating function from setting elements which are effective upon the fibers in respect of the quantity of waste of the fibers;

grouping together into a further one of the respective tables said derived machine setting values of the second machine operating function representative of the quantity of waste of the fibers;

deriving still further machine setting values of a still further machine operating function from setting elements which are effective upon the fibers in respect of carding of the fibers; and grouping together into a still further table said derived still further machine setting values of the still further machine operating function which are effective upon the fibers in respect of carding of the fibers.

10. The method as defined in claim 1, further including the step of:

deriving machine setting values in respect of bale hardness from setting elements of a bale opening machine which are effective upon the fibers in a bale; and grouping together into a further table said derived machine setting values in respect of bale hardness.

11. The method as defined in claim 5, wherein:

the grouping together into said one respective table of the setting values of the setting elements of the fine cleaning machine entails grouping together into a first group setting values of selectively at least any of the distance of a knife from a beater circle, the distance of a carding element from the beater circle, a predetermined point density of the carding element, a clamping distance of a feed trough with respect to clothing of an opening roller, and the rotational speed of the opening roll; and the grouping together into the remaining one of the respective tables of said derived machine setting values of the second machine operating function representative of the quantity of waste of the fibers entails grouping together into a second group an offset distance between a fiber guide and the knife and the length of a separation gap between the knife and the fiber guide.

12. The method as defined in claim 1, further including the steps of:

displaying as readable values the machine setting values; and performing manual total settings of the machine or machine group with the aid of the displayed machine setting values.

13. The method as defined in claim 1, further including the steps of:

representing the machine setting values as reference values for sensing means and operating means, in order to be able to carry out computer-controlled total settings of the machine or machine group.

14. A fiber cleaning method comprising the steps of:

allocating machine setting values of a machine or machine group of different machines for cleaning fibers, into a first machine operating function representative of the intensity of cleaning of the fibers and a second machine operating function representative of the quantity of fiber waste;

said machine setting values being representative of predetermined variations of setting possibilities of setting elements of the machine or machine group;

forming a parameter field representing a region of useful fiber treatment results derived from a respective table whose contents have been empirically determined for the intensity of cleaning of the fibers and for the quantity of fiber waste, respectively, said parameter field establishing an applicable useful range of the setting possibilities of the setting elements of the machine or the machine group with regard to the intensity of cleaning of the fibers and the quantity of fiber waste;

deriving control signals for setting of the setting elements with regard to the intensity of cleaning of the fibers and the quantity of waste by selecting a working point within the parameter field upon operation of the machine or the machine group;

setting the setting elements of the machine or the machine group of different machines based upon said derived control signals.

15. A method of adjusting a fiber processing machine or a machine group of different fiber processing machines, said method comprising the steps of:

allocating machine setting values of the fiber processing machine or machine group of different fiber processing machines, into a first machine operating function and a second machine operating function;

said machine setting values being representative of predetermined variations of setting possibilities of setting elements of the machine or machine group;

forming a parameter field representing a region of useful fiber processing results derived from a respective table whose contents have been empirically determined for the first machine operating function and the second machine operating function, respectively, said parameter field establishing an applicable useful range of adjustment possibilities of the setting elements of the machine or the machine group with regard to the first machine operating function and the second machine operating function;

selecting a working point within the parameter field, upon operation of the machine or the machine group;

deriving control signals, based upon the working point selected, for adjusting of the setting elements with regard to the first machine operating function and the second machine operating function; and adjusting the setting elements of the machine or the machine group with regard to the first machine operating function and the second machine operating function, based upon the derived control signals.

* * * * *